US006217947B1

(12) United States Patent
Affinito

(10) Patent No.: US 6,217,947 B1
(45) **Date of Patent: *Apr. 17, 2001**

(54) PLASMA ENHANCED POLYMER DEPOSITION ONTO FIXTURES

(75) Inventor: John D. Affinito, Kennewick, WA (US)

(73) Assignee: Battelle Memorial Institute, Richland, WA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/212,774

(22) Filed: Dec. 16, 1998

(51) Int. Cl.[7] ..... H05H 1/24

(52) U.S. Cl. ..... 427/488; 427/398.1; 427/255.23; 427/569

(58) Field of Search ..... 427/255.6, 255.23, 427/569, 488, 398.1

(56) References Cited

U.S. PATENT DOCUMENTS

| | | |
|---|---|---|
| 3,475,307 | 10/1969 | Knox et al. . |
| 3,607,365 | 9/1971 | Lindlof . |
| 4,098,965 | 7/1978 | Kinsman . |
| 4,283,482 | 8/1981 | Hattori et al. . |
| 4,581,337 | 4/1986 | Frey et al. . |
| 4,624,867 | 11/1986 | Iijima et al. . |
| 4,695,618 | 9/1987 | Mowrer . |
| 5,032,461 | 7/1991 | Shaw et al. . |

(List continued on next page.)

FOREIGN PATENT DOCUMENTS

| | | |
|---|---|---|
| 704 297 | 2/1968 | (BE) . |
| 19603746 | 4/1997 | (DE) . |
| 0 340 935 | 11/1989 | (EP) . |
| 0 299 753 | 2/1993 | (EP) . |
| 0 547 550 | 6/1993 | (EP) . |
| 0 590 467 | 4/1994 | (EP) . |
| 0 390 540 | 8/1994 | (EP) . |
| 0 722 787 | 7/1996 | (EP) . |
| 0 787 826 | 8/1997 | (EP) . |
| 0 916 394 | 5/1999 | (EP) . |
| 0931 850 | 7/1999 | (EP) . |
| 0 977 469 | 2/2000 | (EP) . |

(List continued on next page.)

OTHER PUBLICATIONS

G Gustafson, Y. Cao, G.M. Treacy, F. Klavetter, N. Colaneri, and A.J. Heeger, Nature, vol. 35, Jun. 11, 1992, pp. 477–479.

J.D. Affinito, M.E. Gross, C.A. Coronado, G.L. Graff, E.N. Greenwell, and P.M. Martin, Polymer–Oxide Transparent Barrier Layers Produced Using The PML Process, 39$^{th}$ Annual Technical Conference Proceedings of the Society of Vaccum Coaters, Vaccum Web Coating Session, 1996, pp. 392–397.

(List continued on next page.)

*Primary Examiner*—Shrive Beck
*Assistant Examiner*—Bret Chen
(74) *Attorney, Agent, or Firm*—Killworth, Gottman, Hagan & Schaeff, L.L.P.

(57) ABSTRACT

Generally, the method of the present invention has the steps of (a) flash evaporating a liquid monomer forming an evaporate; (b) passing the evaporate to a glow discharge electrode creating a glow discharge monomer plasma from the evaporate; and (c) cryocondensing the glow discharge monomer plasma on a fixture and crosslinking the glow discharge plasma thereon, wherein the crosslinking results from radicals created in the glow discharge plasma and achieves self curing.

20 Claims, 3 Drawing Sheets

U.S. PATENT DOCUMENTS

| | | | | |
|---|---|---|---|---|
| 5,237,439 | | 8/1993 | Misono et al. . | |
| 5,354,497 | | 10/1994 | Fukuchi et al. . | |
| 5,395,644 | | 3/1995 | Affinito . | |
| 5,427,638 | | 6/1995 | Goetz et al. . | |
| 5,440,446 | | 8/1995 | Shaw et al. . | |
| 5,536,323 | | 7/1996 | Kirlin et al. . | |
| 5,547,508 | | 8/1996 | Affinito . | |
| 5,554,220 | | 9/1996 | Forrest et al. . | |
| 5,576,101 | | 11/1996 | Saitoh et al. . | |
| 5,607,789 | | 3/1997 | Treger et al. . | |
| 5,620,524 | | 4/1997 | Fan et al. . | |
| 5,629,389 | | 5/1997 | Roitman et al. . | |
| 5,654,084 | | 8/1997 | Egert . | |
| 5,681,615 | * | 10/1997 | Affinito et al. | 427/314 |
| 5,681,666 | | 10/1997 | Treger et al. . | |
| 5,686,360 | | 11/1997 | Harvey, III et al. . | |
| 5,693,956 | | 12/1997 | Shi et al. . | |
| 5,711,816 | | 1/1998 | Kirlin et al. . | |
| 5,725,909 | * | 3/1998 | Shaw et al. | 427/255.6 |
| 5,731,661 | | 3/1998 | So et al. . | |
| 5,747,182 | | 5/1998 | Friend et al. . | |
| 5,757,126 | | 5/1998 | Harvey, III et al. . | |
| 5,759,329 | | 6/1998 | Krause et al. . | |
| 5,792,550 | | 8/1998 | Phillips et al. . | |
| 5,811,177 | | 9/1998 | Shi et al. . | |
| 5,811,183 | | 9/1998 | Shaw et al. . | |
| 5,821,692 | | 10/1998 | Rogers et al. . | |
| 5,844,363 | | 12/1998 | Gu et al. . | |
| 5,872,355 | | 2/1999 | Hueschen . | |
| 5,902,641 | * | 5/1999 | Affinito et al. | 427/255.2 |
| 5,902,688 | | 5/1999 | Antoniadis et al. . | |
| 5,904,958 | * | 5/1999 | Dick et al. | 427/255.6 |
| 5,912,069 | | 6/1999 | Yializis et al. . | |
| 5,922,161 | | 7/1999 | Wu et al. . | |
| 5,945,174 | | 8/1999 | Shaw et al. . | |
| 5,948,552 | | 9/1999 | Antoniadis et al. . | |
| 5,965,907 | | 10/1999 | Huang et al. . | |
| 5,996,498 | | 12/1999 | Lewis . | |
| 6,045,864 | | 4/2000 | Lyons et al. . | |

FOREIGN PATENT DOCUMENTS

| | | |
|---|---|---|
| 63-136316 | 6/1988 | (JP) . |
| 64-18441 | 1/1989 | (JP) . |
| 2-183230 | 7/1990 | (JP) . |
| 08325713 | 12/1996 | (JP) . |
| 09059763 | 3/1997 | (JP) . |
| WO 87 07848 | 12/1987 | (WO) . |
| WO 95 10117 | 4/1995 | (WO) . |
| WO 97 04885 | 2/1997 | (WO) . |
| WO 97 22631 | 6/1997 | (WO) . |
| WO 98 10116 | 3/1998 | (WO) . |
| WO 98 18852 | 5/1998 | (WO) . |
| WO 99 16557 | 4/1999 | (WO) . |
| WO 99 16931 | 4/1999 | (WO) . |

OTHER PUBLICATIONS

J.D. Affinito, Stephan, Eufinger, M.E. Gross, G.L. Graff, and P.M. Martin, PML/Oxide/PML Barrier Layer Performance Differences Arising From Use of UV or Electron Beam Polymerization of the PML Layers, Thin Solid Films, vol. 308, 1997, pp. 19–25.

PCT International Search Report for International application No. PCT/US 99/30071 dated Sep. 5, 2000.

Affinito, J.D., Et Al, "Vacuum Deposition of Polymer Electrolytes On Flexible Substrates", "Proceedings of the NInth International Conference on Vacuum Web Coating", Nov. 1995 ed R. Bakish, Bakish Press 1995, p. 20–36.

Vossen, J.L., Et Al., Thin Film Processes, Academic Press, 1978, Part II, Chapter II–1, Glow Discharge Sputter Deposition, p. 12–63; Part IV, Chapter IV–1 Plasma Deposition of Inorganic Compounds and Chapter IV–2 Glow Discharge Polymerization, p. 335–397.

Penning, F.M., Et. Al, Electrical Discharges In Gasses, Gordon and Breach Science Publishers, 1965, Chapters 5–6, p. 19–35, and Chapter 8, p. 41–50.

Affinito, J.D., Et Al., "High Rate Vacuum Deposition of Polymer Electrolytes", Journal Vacuum Science Technology A 14(3), May/Jun. 1996 No Pages Numbers.

Inoue Et Al., Proc. Jpn. Congr. Mater. Res., vol. 33, pp. 177–9, 1990.

* cited by examiner

PLASMA ENHANCED POLYMER DEPOSITION ONTO FIXTURES

FIELD OF THE INVENTION

The present invention relates generally to a method of making plasma polymerized films on a fixture.

As used herein, a fixture is a discrete item. Examples include but are not limited to plumbing fixtures, cabinetry fixtures, tools, optical fixtures including reflectors, light covers, solar collectors and combinatiions thereof which are clearly distinct from a continuous item for example a sheet, wire, or rope.

As used herein, the term "(meth)acrylic" is defined as "acrylic or methacrylic". Also, "(meth)acrylate" is defined as "acrylate or methacrylate".

As used herein, the term "cryocondense" and forms thereof refers to the physical phenomenon of a phase change from a gas phase to a liquid phase upon the gas contacting a surface having a temperature lower than a dew point of the gas.

BACKGROUND OF THE INVENTION

The basic process of flash evaporation is described in U.S. Pat. No. 4,954,371 herein incorporated by reference. This basic process may also be referred to as polymer multi-layer (PML) flash evaporation. Briefly, a radiation polymerizable and/or cross linkable material is supplied at a temperature below a decomposition temperature and polymerization temperature of the material. The material is atomized to droplets having a droplet size ranging from about 1 to about 50 microns. An ultrasonic atomizer is generally used. The droplets are then flash vaporized, under vacuum, by contact with a heated surface above the boiling point of the material, but below the temperature which would cause pyrolysis. The vapor is cryocondensed on a substrate then radiation polymerized or cross linked as a very thin polymer layer. The material may include a base monomer or mixture thereof, cross-linking agents and/or initiating agents. A disadvantage of the flash evaporation method with radiation cross linking is that it requires two sequential steps, cryocondensation followed by curing or cross linking, that are both spatially and temporally separate. A disadvantage of this radiation crosslinking method is the time between cryocondensation and curing permitting the cryocondensed monomer to flow or run, especially on fixtures having irregular non-flat geometry, leading to non-uniformity of coating (FIG. 1*a*) so that the coating surface 150 is geometrically different from the substrate surface 160. Reducing surface temperature can reduce the flow somewhat, but should the monomer freeze, then cross linking is adversely affected. Using higher viscosity monomers is unattractive because of the increased difficulty of degassing, stirring, and dispensing of the monomer The basic process of plasma enhanced chemical vapor deposition (PECVD) is described in THIN FILM PROCESSES, J. L. Vossen, W. Kern, editors, Academic Press, 1978, Part IV, Chapter IV-1 Plasma Deposition of Inorganic Compounds, Chapter IV-2 Glow Discharge Polymerization, herein incorporated by reference. Briefly, a glow discharge plasma is generated on an electrode that may be smooth or have pointed projections. Traditionally, a gas inlet introduces high vapor pressure monomeric gases into the plasma region wherein radicals are formed so that upon subsequent collisions with the substrate, some of the radicals in the monomers chemically bond or cross link (cure) on the substrate. The high vapor pressure monomeric gases include gases of $CH_4$, $SiH_4$, $C_2H_2$, $C_2H_2$, or gases generated from high vapor pressure liquid, for example styrene (10 torr at 87.4° F. (30.8° C.)), hexane (100 torr at 60.4° F. (15.8° C.)), tetramethyldisiloxane (10 torr at 82.9° F. (28.3° C.) 1,3,-dichlorotetra-methyldisiloxane) and combinations thereof that may be evaporated with mild controlled heating. Because these high vapor pressure monomeric gases do not readily cryocondense at ambient or elevated temperatures, deposition rates are low (a few tenths of micrometer/min maximum) relying on radicals chemically bonding to the surface of interest instead of cryocondensation. The low deposition rate is not useable in a high rate industrial application. Remission due to etching of the surface of interest by the plasma competes with deposition of the radicals. Lower vapor pressure species have not been used in PECVD because heating the higher molecular weight monomers to a temperature sufficient to vaporize them generally causes a reaction prior to vaporization, or metering of the gas becomes difficult to control, either of which is inoperative.

According to the state of the art of making plasma polymerized films, PECVD and flash evaporation or glow discharge plasma deposition and flash evaporation have not been used in combination. However, plasma treatment of a substrate using glow discharge plasma generator with inorganic compounds has been used in combination with flash evaporation under a low pressure (vacuum) atmosphere as reported in J. D. Affinito, M. E. Gross, C. A. Coronado, and P. M. Martin, A Vacuum Deposition Of Polymer Electrolytes On Flexible Substrates. "Paper for Plenary talk in A Proceedings of the Ninth International Conference on Vacuum Web Coating", November 1995 ed R. Bakish, Bakish Press 1995, pg 20–36., and as shown in FIG. 1*b*. In that system, the plasma generator 100 is used to etch the surface 102 of a moving substrate 104 in preparation to receive the monomeric gaseous output from the flash evaporation 106 that cryocondenses on the etched surface 102 and is then passed by a first curing station (not shown), for example electron beam or ultra-violet radiation, to initiate cross linking and curing. The plasma generator 100 has a housing 108 with a gas inlet 110. The gas may be oxygen, nitrogen, water or an inert gas, for example argon, or combinations thereof. Internally, an electrode 112 that is smooth or having one or more pointed projections 114 produces a glow discharge and makes a plasma with the gas which etches the surface 102. The flash evaporator 106 has a housing 116, with a monomer inlet 118 and an atomizing nozzle 120, for example an ultrasonic atomizer. Flow through the nozzle 120 is atomized into particles or droplets 122 which strike the heated surface 124 whereupon the particles or droplets 122 are flash evaporated into a gas that flows past a series of baffles 126 (optional) to an outlet 128 and cryocondenses on the surface 102. Although other gas flow distribution arrangements have been used, it has been found that the baffles 126 provide adequate gas flow distribution or uniformity while permitting ease of scaling up to large surfaces 102. In the method of radiation curing, a curing station (not shown) is located downstream of the flash evaporator 106. The monomer may be an acrylate (FIG. 1*b*). This system was for planar layer coatings. With radiation curing, the time between deposition and curing permits flow of thicker coating layers leading to non-uniformity of coating on non-uniform surfaces or tilted planar surfaces.

Therefore, there is a need for an apparatus and method for coating fixtures with polymerized layers at a fast rate while avoiding flow of the coating.

SUMMARY OF THE INVENTION

The present invention is a method of making a plasma polymerized film on a fixture. More specifically, the method is for making a self-curing polymer layer, especially self-curing PML polymer layer on a fixture. The method relies upon a combination of flash evaporation with plasma enhanced chemical vapor deposition (PECVD) that provides the unexpected improvements of permitting use of low vapor pressure monomer materials in a PECVD process and provides a self curing from a flash evaporation process at a rate surprisingly faster (2 orders of magnitude or more) than standard PECVD deposition rates. Another advantage of the present invention is the ability to make a conformal coating on a fixture. Because of rapid self curing, the monomer has less time to flow and is therefore more uniformly thick.

The method of the present invention has the steps of (a) flash evaporating a liquid monomer forming an evaporate; (b) passing the evaporate to a glow discharge electrode creating a glow discharge monomer plasma from the evaporate; and (c) cryocondensing the glow discharge monomer plasma on a substrate and crosslinking the glow discharge plasma thereon, wherein the crosslinking results from radicals created in the glow discharge plasma and achieves self curing.

It is an object of the present invention to provide a method combining flash evaporation with glow discharge plasma deposition for polymer coating a fixture.

An advantage of the present invention is that multiple layers of materials may be combined. For example, as recited in U.S. Pat. Nos. 5,547,508 and 5,395,644, 5,260,095, hereby incorporated by reference, multiple polymer layers, alternating layers of polymer and metal, and other layers may be made with the present invention in the vacuum environment.

The subject matter of the present invention is particularly pointed out and distinctly claimed in the concluding portion of this specification. However, both the organization and method of operation, together with further advantages and objects thereof, may best be understood by reference to the following detailed description in combination with the drawings wherein like reference characters refer to like elements.

DESCRIPTION OF THE PREFERRED EMBODIMENT(S)

The present invention is a method of conformally coating a fixture. Fixture is a discrete item including but not limited to plumbing fixtures for example, faucets, spouts and/or valve handles or knobs, cabinetry fixtures, for example pulls or knobs, hinges, tools (especially hand tools), optical fixtures including reflectors, light covers, solar collectors and combinations thereof. A fixture is clearly distinct from and excludes a continuous item for example a sheet, wire, or rope. A conformal coating on a portion of a fixture is illustrated in FIG. 2*b* wherein a coating surface 150 is geometrically similar to the fixture surface 160.

Figure 3:
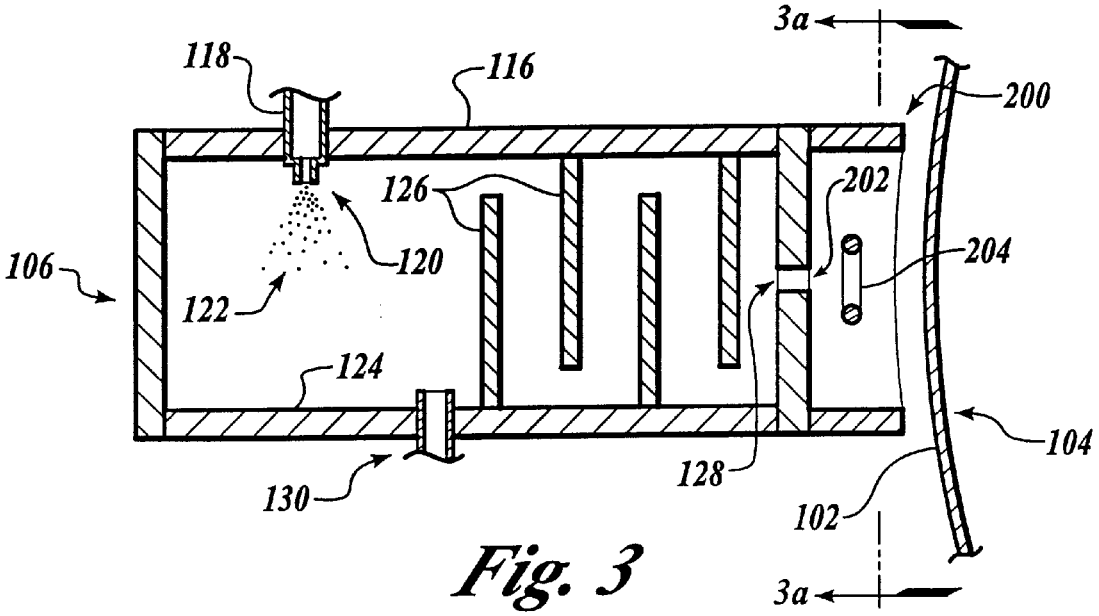
FIG. 3 is a cross section of the apparatus of the present invention of combined flash evaporation and glow discharge plasma deposition.
Figure 3A:
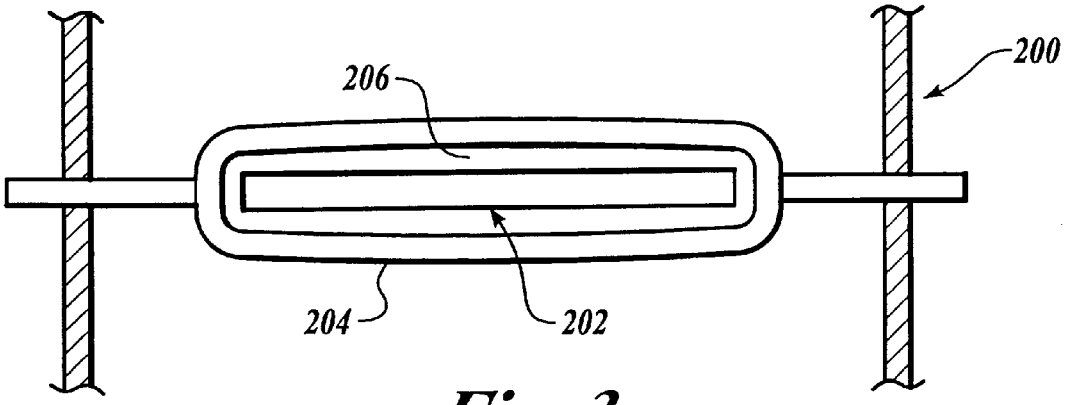
FIG. 3*a* is a cross section end view of the apparatus of the present invention.
Figure 4:
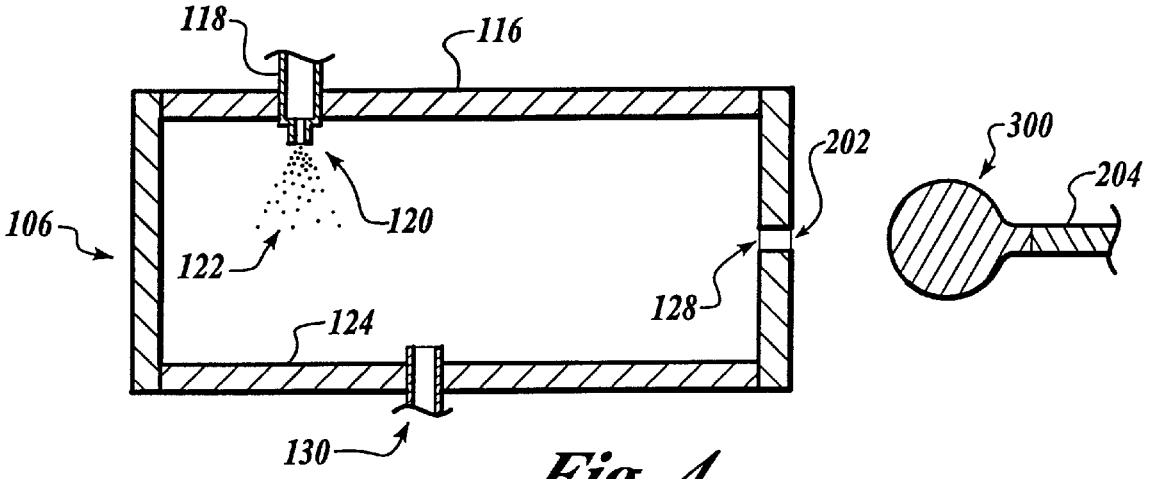
FIG. 4 is a cross section of the present invention wherein the substrate or fixture is the electrode.
Figure 5:
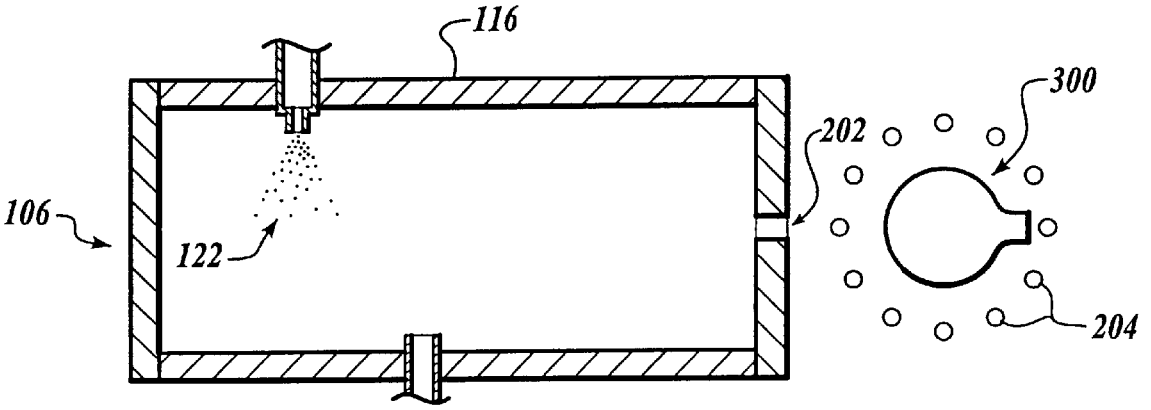
FIG. 5 is a cross section of the present invention wherein a plurality of electrodes surrounds the substrate or fixture.

The method of the present invention is done with the apparatus of FIG. 3, FIG. 4 or FIG. 5, preferably within a low pressure (vacuum) environment or chamber. Pressures preferably range from about $10^{-1}$ torr to $10^{-6}$ torr. The flash evaporator 106 has a housing 116, with a monomer inlet 118 and an atomizing nozzle 120. Flow through the nozzle 120 is atomized into particles or droplets 122 which strike the heated surface 124 whereupon the particles or droplets 122 are flash evaporated into a gas or evaporate that flows past a series of baffles 126 to an evaporate outlet 128 and cryocondenses on the surface 102. Cryocondensation on the baffles 126 and other internal surfaces is prevented by heating the baffles 126 and other surfaces to a temperature in excess of a cryocondensation temperature or dew point of the evaporate. Although other gas flow distribution arrangements have been used, it has been found that the baffles 126 provide adequate gas flow distribution or uniformity while permitting ease of scaling up to large surfaces 102. The evaporate outlet 128 directs gas toward a glow discharge electrode 204 creating a glow discharge plasma from the evaporate. In the embodiment shown in FIG. 3, the glow discharge electrode 204 is placed in a glow discharge housing 200 having an evaporate inlet 202 proximate the evaporate outlet 128. In this embodiment, the glow discharge housing 200 and the glow discharge electrode 204 are maintained at a temperature above a dew point of the evaporate. The glow discharge plasma exits the glow discharge housing 200 and cryocondenses on the surface 102 of the substrate (fixture) 104. It is preferred that the substrate 104 is kept at a temperature below a dew point of the evaporate, preferably ambient temperature or cooled below ambient temperature to enhance the cryocondensation rate. In this embodiment, the substrate 104 may be electrically grounded, electrically floating, or electrically biased with an impressed voltage to draw charged species from the glow discharge plasma. If the substrate 104 is electrically biased, it may even replace the electrode 204 and be, itself, the electrode which creates the glow discharge plasma from the monomer gas. Substantially not electrically biased means that there is no impressed voltage although a charge may build up due to static electricity or due to interaction with the plasma.

Figure 1A:
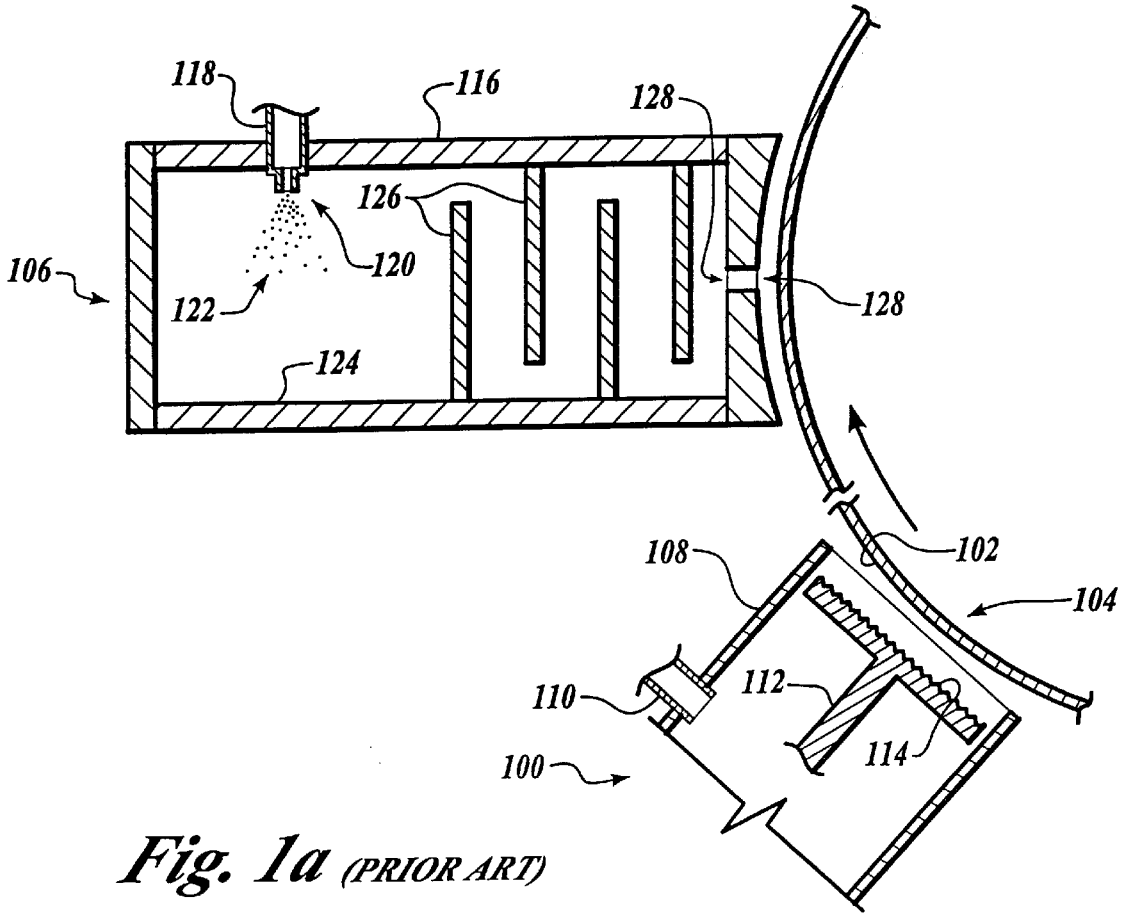
Fig. 1a (PRIOR ART)
FIG. 1*a* is a cross section of a prior art combination of a glow discharge plasma generator with inorganic compounds with flash evaporation.
Figure 1B:
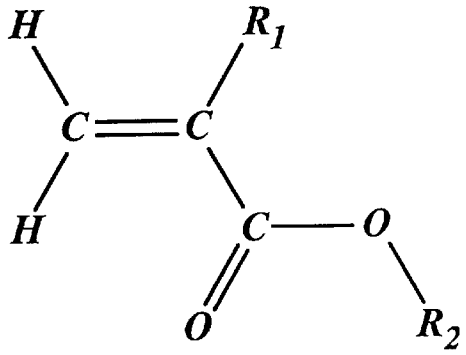
Fig. 1b (PRIOR ART)
FIG. 1*b* is a chemical diagram of an acrylate.
Figure 2A:
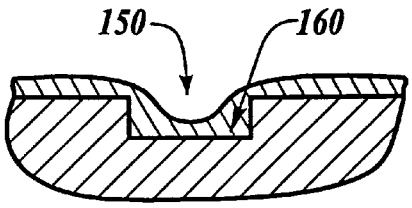
Fig. 2a (PRIOR ART)
FIG. 2*a* is an illustration of non-conformal coating.
Figure 2B:
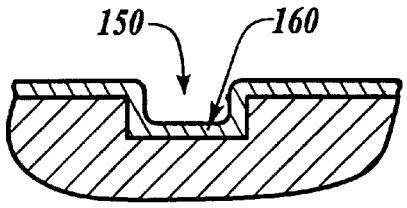
FIG. 2*b* is an illustration of a conformal coating.

A preferred shape of the glow discharge electrode 204, is shown in FIG. 2*a*. In this preferred embodiment, the glow discharge electrode 204 is separate from the substrate 104 and shaped so that evaporate flow from the evaporate inlet 202 substantially flows through an electrode opening 206. Any electrode shape can be used to create the glow discharge, however, the preferred shape of the electrode 204 does not shadow the plasma from the evaporate issuing from the outlet 202 and its symmetry, relative to the monomer exit slit 202 and substrate 104, provides uniformity of the evaporate vapor flow to the plasma across the width of the substrate while uniformity transverse to the width. The spacing of the electrode 204 from the substrate 104 is a gap or distance that permits the plasma to impinge upon the substrate. This distance that the plasma extends from the electrode will depend on the evaporate species, electrode 204/substrate 104 geometry, electrical voltage and frequency, and pressure in the standard way as described in detail in ELECTRICAL DISCHARGES IN GASSES, F. M. Penning, Gordon and Breach Science Publishers, 1965, and summarized in THIN FILM PROCESSES, J. L. Vossen, W. Kern, editors, Academic Press, 1978, Part II, Chapter II-1, Glow Discharge Sputter Deposition, both hereby incorporated by reference. Alternatively, the electrode 204 may be a plurality of electrodes distributed throughout the volume of the vacuum chamber defined by the housing 116.

An alternative apparatus also suitable for batch operation is shown in FIG. 4. In this embodiment, the glow discharge electrode 204 is sufficiently proximate a part 300 (substrate) that the part 300 is an extension of or part of the electrode 204. Moreover, the part is below a dew point to allow cryocondensation of the glow discharge plasma on the part 300 and thereby coat the part 300 with the monomer condensate and self cure into a polymer layer. Sufficiently proximate may be connected to, resting upon, in direct contact with, or separated by a gap or distance that permits the plasma to impinge upon the substrate. This distance that the plasma extends from the electrode will depend on the evaporate species, electrode 204/substrate 104 geometry, electrical voltage and frequency, and pressure in the standard way as described in ELECTRICAL DISCHARGES IN GASSES, F. M. Penning, Gordon and Breach Science Publishers, 1965, hereby incorporated by reference. The substrate 104, 300 may be stationary or moving during cryocondensation. Moving includes rotation and translation and may be employed for controlling the thickness and uniformity of the monomer layer cryocondensed thereon. Because the cryocondensation occurs rapidly, within milliseconds to seconds, the part may be removed after coating and before it exceeds a coating temperature limit.

Another embodiment for non or marginally electrically conductive fixtures is shown in FIG. 5 wherein electrode elements 204 surround the fixture 300.

In operation, the method of the invention has the steps of (a) flash evaporating a liquid monomer forming an evaporate; (b) passing the evaporate to a glow discharge electrode creating a glow discharge monomer plasma from the evaporate; and (c) cryocondensing the glow discharge monomer plasma on a fixture 104, 300 and crosslinking the glow discharge plasma thereon. The crosslinking results from radicals created in the glow discharge plasma thereby permitting self curing.

The flash evaporating has the steps of flowing a monomer liquid to an inlet, atomizing the monomer liquid through a nozzle and creating a plurality of monomer particles of the monomer liquid as a spray. The spray is directed onto a heated evaporation surface whereupon it is evaporated and discharged through an evaporate outlet. By using flash evaporation, the monomer is vaporized so quickly that reactions that generally occur from heating a liquid monomer to an evaporation temperature simply do not occur. Further, control of the rate of evaporate delivery is strictly controlled by the rate of liquid monomer delivery to the inlet 118 of the flash evaporator 106.

The liquid monomer may be any liquid monomer. However, it is preferred that the monomer material or liquid have a low vapor pressure at ambient temperatures so that it will readily cryocondense. Preferably, the vapor pressure of the monomer material is less than about 10 torr at 83° F. (28.3° C.), more preferably less than about 1 torr at 83° F. (28.3° C.), and most preferably less than about 10 millitorr at 83° F. (28.3° C.). For monomers of the same chemical family, monomers with low vapor pressures usually also have higher molecular weight and are more readily cryocondensible than higher vapor pressure, lower molecular weight monomers. Liquid monomer includes but is not limited to (meth)acrylate monomers, for example tripropyleneglycol diacrylate, tetraethylene glycol diacrylate, tripropylene glycol monoacrylate, caprolactone acrylate, and combinations thereof.

In addition to the evaporate from the liquid monomer, additional gases may be added within the flash evaporator 106 through a gas inlet 130 upstream of the evaporate outlet 128, preferably between the heated surface 124 and the first baffle 126 nearest the heated surface 124. Additional gases may be organic or inorganic for purposes included but not limited to ballast, reaction and combinations thereof. Ballast refers to providing sufficient molecules to keep the plasma lit in circumstances of low evaporate flow rate. Reaction refers to chemical reaction to form a compound different from the evaporate. Additional gases include but are not limited to group VIII of the periodic table, hydrogen, oxygen, nitrogen, chlorine, bromine, polyatomic gases including for example carbon dioxide, carbon monoxide, water vapor, and combinations thereof. An exemplary reaction is by addition of oxygen gas to the monomer evaporate hexamethylydisiloxane to obtain silicon dioxide.

An advantage of the present invention is the ability to make conformal coatings. Because of rapid plasma polymerization, the monomer has less time to flow and is therefore more uniformly thick even under conditions of substrate temperature and deposition rate that would produce non-conformal coatings using conventional deposition with significantly more time between condensation and polymerization.

CLOSURE

While a preferred embodiment of the present invention has been shown and described, it will be apparent to those skilled in the art that many changes is and modifications may be made without departing from the invention in its broader aspects. The appended claims are therefore intended to cover all such changes and modifications as fall within the true spirit and scope of the invention.

I claim:

1. A method for plasma enhanced chemical vapor deposition of low vapor pressure monomeric materials onto a fixture in a vacuum environment, comprising the steps of:

(a) making an evaporate by receiving a plurality of monomer particles of the low vapor pressure monomeric materials as a spray into a flash evaporating housing, evaporating said spray on an evaporation surface, and discharging said evaporate through an evaporate outlet;

(b) making a monomer plasma from said evaporate by passing said evaporate proximate a glow discharge electrode for making said plasma from said evaporate; and (c) cryocondensing said monomer plasma onto said fixture.

2. The method as recited in claim 1, wherein said fixture is proximate the glow discharge electrode, is electrically biased with an impressed voltage, and receives said monomer plasma cryocondensing thereon.

3. The method as recited in claim 1, wherein said glow discharge electrode is positioned within a glow discharge housing having an evaporate inlet proximate the evaporate outlet, said glow discharge housing and said glow discharge electrode maintained at a temperature above a dew point of said evaporate, said fixture is downstream of said monomer plasma, is electrically floating, and receives said monomer plasma cryocondensing thereon.

4. The method as recited in claim 1, wherein said fixture is proximate the glow discharge electrode, is electrically grounded, and receives said monomer plasma cryocondensing thereon.

5. The method as recited in claim 1, wherein said monomer is selected from the group consisting of acrylate monomer, methacrylate monomer and combinations thereof.

6. The method as recited in claim 5, wherein said acrylate monomer is selected from the group consisting of tripropyleneglycol diacrylate, tetraethylene glycol diacrylate, tripropylene glycol monoacrylate, caprolactone acrylate, and combinations thereof.

7. The method as recited in claim 1, wherein said fixture is cooled.

8. The method as recited in claim 1, further comprising adding an additional gas.

9. The method as recited in claim 8, wherein said additional gas is a ballast gas.

10. The method as recited in claim 8, wherein said additional gas is a reaction gas.

11. A method for conformally coating a fixture in a vacuum chamber, comprising:

(a) flash evaporating a coating material monomer forming an evaporate;

(b) passing said evaporate to a glow discharge electrode creating a glow discharge monomer plasma from said evaporate; and (c) cryocondensing said glow discharge monomer plasma as a condensate on said fixture and crosslinking said glow discharge monomer plasma thereon, said crosslinking resulting from radicals created in said glow discharge monomer plasma.

12. The method as recited in claim 11, wherein said fixture is proximate the glow discharge electrode, is electrically biased with an impressed voltage, and receives said glow discharge monomer plasma cryocondensing thereon.

13. The method as recited in claim 11, wherein said glow discharge electrode is positioned within a glow discharge housing having an evaporate inlet proximate the evaporate outlet, said glow discharge housing and said glow discharge electrode maintained at a temperature above a dew point of said evaporate, said fixture is downstream of said glow discharge monomer plasma, is electrically floating, and receives said glow discharge monomer plasma cryocondensing thereon.

14. The method as recited in claim 11, wherein said fixture is proximate said glow discharge electrode, is electrically grounded, and receives said glow discharge monomer plasma cryocondensing thereon.

15. The method as recited in claim 11, wherein said monomer is selected from the group consisting of acrylate monomer, methacrylate monomer, and combinations thereof.

16. The method as recited in claim 15, wherein said acrylate monomer is selected from the group consisting of tripropyleneglycol diacrylate, tetraethylene glycol diacrylate, tripropylene glycol monoacrylate, caprolactone acrylate, and combinations thereof.

17. The method as recited in claim 11, wherein said fixture is cooled.

18. The method as recited in claim 11, further comprising an additional gas.

19. The method as recited in claim 18, wherein said additional gas is a ballast gas.

20. The method as recited in claim 18, wherein said additional gas is a reaction gas.

* * * * *

UNITED STATES PATENT AND TRADEMARK OFFICE

CERTIFICATE OF CORRECTION

PATENT NO. : 6,217,947 B1
DATED : April 17, 2001
INVENTOR(S) : John D. Affinito

It is certified that error appears in the above-identified patent and that said Letters Patent is hereby corrected as shown below:

Column 2,
Line 1, "$C_2H_2$, $C_2H_2$," should be -- $C_2H_6$, $C_2H_2$, --

Signed and Sealed this

Fifth Day of November, 2002

*Attest:*

*Attesting Officer*

JAMES E. ROGAN
*Director of the United States Patent and Trademark Office*